US005647688A

United States Patent [19]

Guntert et al.

[11] Patent Number: 5,647,688

[45] Date of Patent: Jul. 15, 1997

[54] PAVING MACHINE WITH EXTENDED TELESCOPING MEMBERS

[75] Inventors: Ronald M. Guntert, Stockton, Calif.; William R. Cape, Racine, Wis.

[73] Assignee: Guntert & Zimmerman Const. Div., Inc., Ripon, Calif.

[21] Appl. No.: 570,760

[22] Filed: Dec. 12, 1995

Related U.S. Application Data

[63] Continuation-in-part of Ser. No. 504,858, Jul. 20, 1995.

[51] Int. Cl.[6] ..... E01C 19/00

[52] U.S. Cl. ..... 404/101; 404/105; 280/638

[58] Field of Search ..... 404/72, 75, 101, 404/102, 104, 105, 118, 98; 280/638

[56] References Cited

U.S. PATENT DOCUMENTS 3,970,405 7/1976 Swisher, Jr. et al. ..... 404/105

4,789,266 12/1988 Clarke, Jr. et al. ..... 404/104 X

*Primary Examiner*—James A. Lisehora

*Attorney, Agent, or Firm*—Townsend and Townsend and Crew LLP

[57] ABSTRACT

A conventional telescoping frame on a paving tractor is provided with fixed male extension members for insertion to and attachment with a telescoping frame member. The conventional telescoping frame includes paired forward and paired rear side-by-side female tube members. Each forward and rear tube member conventionally acts for the telescoping support of male extension members which attach directly to the cylinder and crawler via a side bolster. Within the limits of expansion, the male extension members co-acting with clamps acting through the female tube members provide for both movement of the point of crawler support and expansion of the paving width of the tractor frame. Into this combination, extenders are added for attachment to the supported end of the male extension members interior of the female telescoping members. During frame width expansion, the male telescoping members are expanded to register their ends interior of the female telescoping members to attachment access ports in the female telescoping member. The extenders are inserted, supported, and registered at complimentary attachment apertures with attachment to the males telescoping members taking place. Once attachment has occurred, further extension of the male telescoping members occurs. A simple system of pinned cross-bracing reinforces the extended frame with relatively light bracing members. Provision is made for extender gathering to the male telescoping member interior of the box beams to facilitate ready extender connection.

1 Claim, 10 Drawing Sheets

PAVING MACHINE WITH EXTENDED TELESCOPING MEMBERS

This application is a Continuation-In-Part of patent application Ser. No. 08/504,858 filed Jul. 20, 1995 entitled Paving Machine with Extended Telescoping Members.

This invention relates to concrete pavers of the slipform variety. More particularly, a concrete paver is disclosed in which telescoping frame members extending across the paver are provided with extension members. These extension members enable the paver to expand to paving widths beyond that presently achieved by conventional telescoping members. Further, the present disclosure does away with the necessity of the installation of a fixed frame extension members. As a result, this invention also substantially reduces machine preparation time for paving at differing machine widths.

BACKGROUND OF THE INVENTION

Concrete slipform pavers are known. Specifically, such pavers include a "tractor" and a "paving kit".

Regarding the tractor, most concrete slipform pavers include a tractor which is comprised of a rectilinear frame which straddles the concrete roadway or runway while it is paved. This frame is propelled and supported on either end by side bolsters and crawler track(s). The frame supports a diesel engine driven hydraulic power unit which supplies power to the tractor and paving kit.

The paving kit is typically suspended below the tractor frame by mechanical means. The paving kit takes its hydraulic power from the power unit on the tractor. The tractor and paving kit comprising the slipform pass over the concrete placed in its path in a relatively even and level mass that can be conveniently paved. During this slipform process the tractor attached paving kit spreads the concrete dumped in the path of the paver, levels and vibrates it into a semi-liquid state, then confines and finishes the concrete into a slab with an upwardly exposed and finished surface. Sideforms mounted to the side of the slipform kit confine the sides of the slab during the paving process.

The tractor typically has either two or four crawler tracks supporting and propelling the frame and attached paving kit. Other kits can be attached to these tractors such as kits for conveying and spreading concrete and trimming and spreading base materials. For the purposes of this description, we will focus on the paving kit used for slipform paving.

With respect to both two and four track pavers, the tractor frame is known to telescope itself normal to the direction of the paving movement. This telescoping normal to the direction of the paving movement enables the tractor frame to span different widths of pavements within the limits of the telescopic extensions. Once these telescopic extensions limits are reached, a fixed frame extension can be added to one or both sides of the telescopic frame for further extension. Despite the telescopic ability of the frame, the process is still a relatively complex and time consuming operation. Adding a fixed frame extension(s) significantly increases the complexity and difficulty of the frame width change.

Regarding the addition of the fixed frame extension, this addition requires that the side bolster and crawler(s) on at least one side of the machine be removed, the fixed frame extension inserted, and the side bolster and crawlers re-attached. Hydraulic and electrical lines must also be disconnected then reconnected. This is not a trivial operation. The frame section and side bolster/-crawlers are heavy members. They must be separately manipulated into place —usually by cranes and their attendant crews. Cranes have scheduling problems, are big, heavy, dangerous, and slow.

SUMMARY OF THE INVENTION

A conventional telescoping frame on a paving tractor is provided with fixed frame extension members for insertion to and attachment with a telescoping frame member. The conventional telescoping frame includes paired forward and paired rear side-by-side female tube members. Each forward and rear tube member conventionally acts for the telescoping support of male extension members which attach directly to the side bolster, which in turn attaches to the hydraulic jacking columns and crawlers. Within the limits of expansion, the male extension members co-acting with clamps acting through the female tube members provide for both movement of the point of crawler support and expansion of the paving width of the tractor frame. Into this combination, extenders are added for attachment to the supported end of the male extension members interior of the female telescoping members. During frame width expansion, the male telescoping members are expanded to register their ends interior of the female telescoping members to attachment access ports in the female telescoping member. The extenders are inserted, supported, and registered at complimentary attachment apertures with attachment to the male telescoping members taking place. Once attachment has occurred, further extension of the male telescoping members occurs. A simple system of pinned cross-bracing reinforces the extended frame with relatively light bracing members. When the telescoping members at both sides of the frame are provided with the extenders to extend the telescoping span of the paver, a tractor of greater expansion and range of expansion capability is provided which obviates the need for fixed frame extensions, and permit frame expansion without heavy lifting equipment.

A system of mating the extenders to male telescoping members is disclosed. The male telescoping member includes single male flange having paired upper and lower pin apertures. Similarly, extenders include paired female flange members with mating upper pin aperture and lower pin apertures. Centrally, and between the paired female flange members, there is a locator pin within the extender. Similarly, and in the single male flange between the pair upper and low pin apertures, there is a locator aperture with gathering surfaces.

In operation, the male telescoping member is extended by crawler movement until registration of the paired upper and lower pin apertures occurs at elongate upper and lower apertures in the box beams. Thereafter, extender insertion occurs with the single male flange penetrating to the locator pin first at the gathering surfaces and then at the locator aperture. With full insertion of the extender, the end of the extender is raised or lowered to center either and upper or lower pin. Once the upper or lower pin is centered, pin insertion occurs. Assuming registration of at least one pin and the locator pin at the locator aperture, insertion of the remaining pin readily follows. Rapid extender connection results.

DESCRIPTION OF THE PREFERRED EMBODIMENT

Figure 1A:
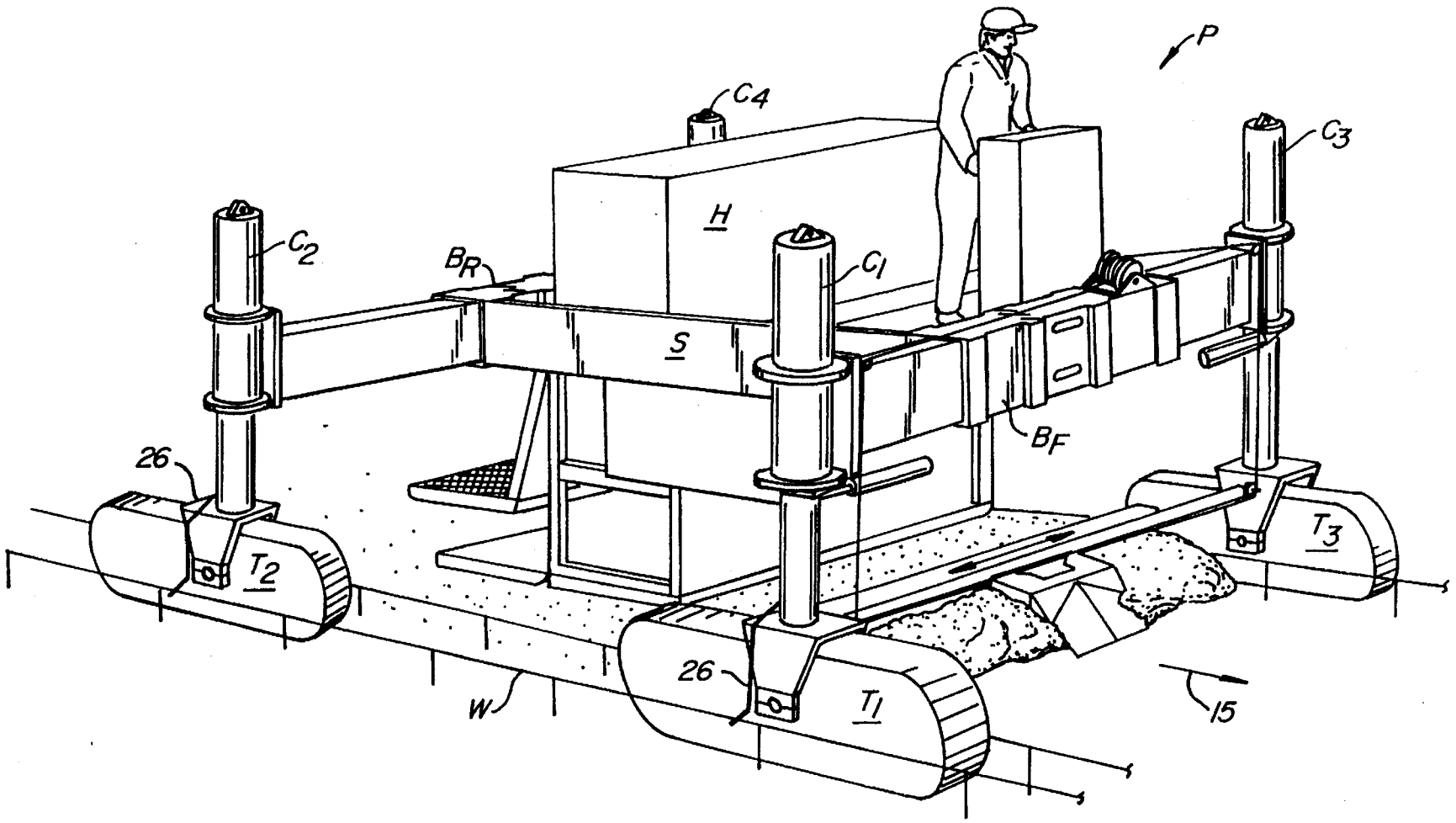
FIG. 1A is a perspective view of a concrete paver of this invention in conventional operation.
Figure 1B:
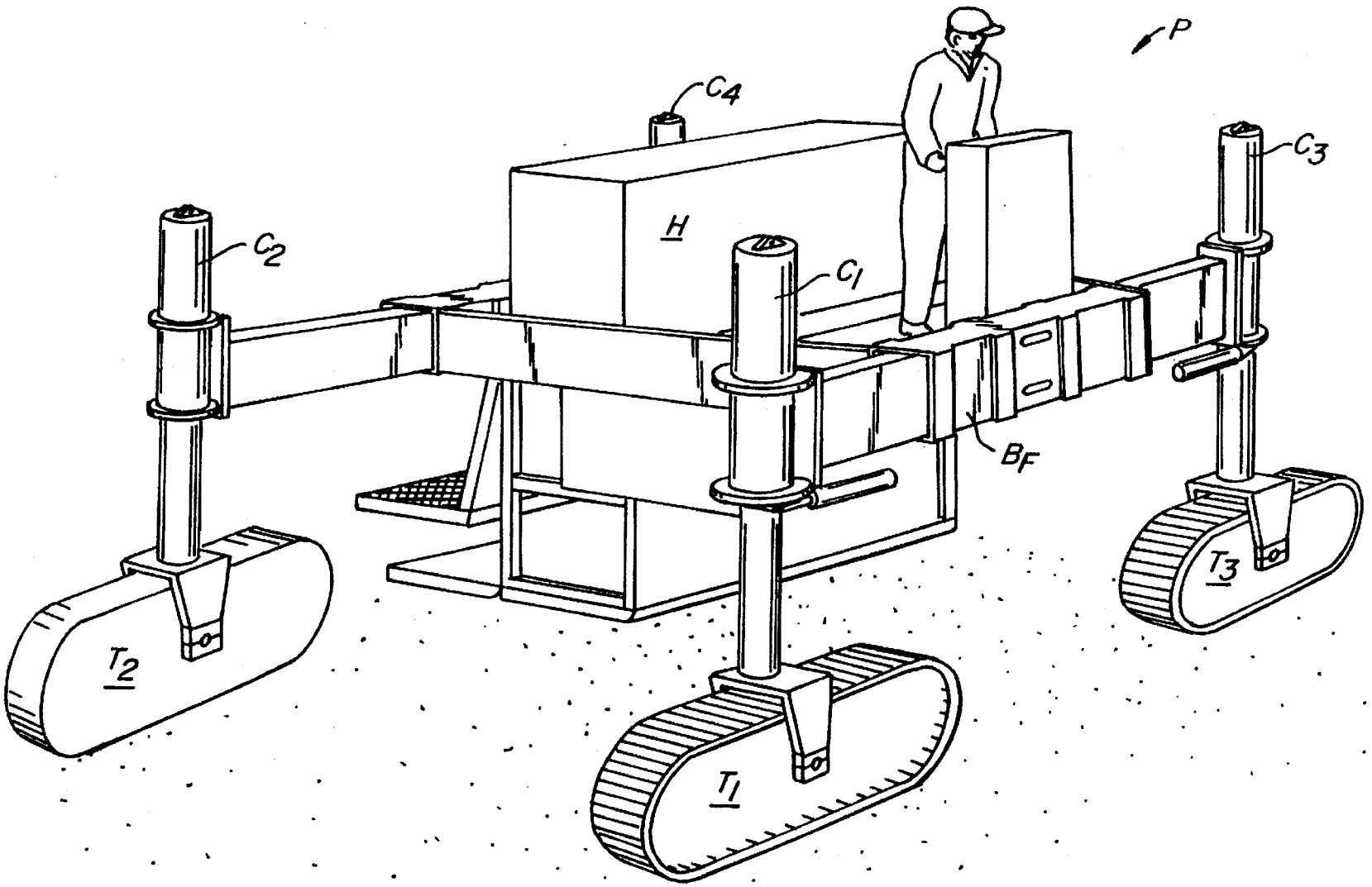
FIG. 1B is a perspective view of a concrete paver illustrating the crawler tracks turned 90° from the paving disposition illustrated in FIG. 1A and with the telescoping members in an orientation where the extending members may be inserted into the paver female telescoping tractor frame to increase the paving width.
Figure 1C:
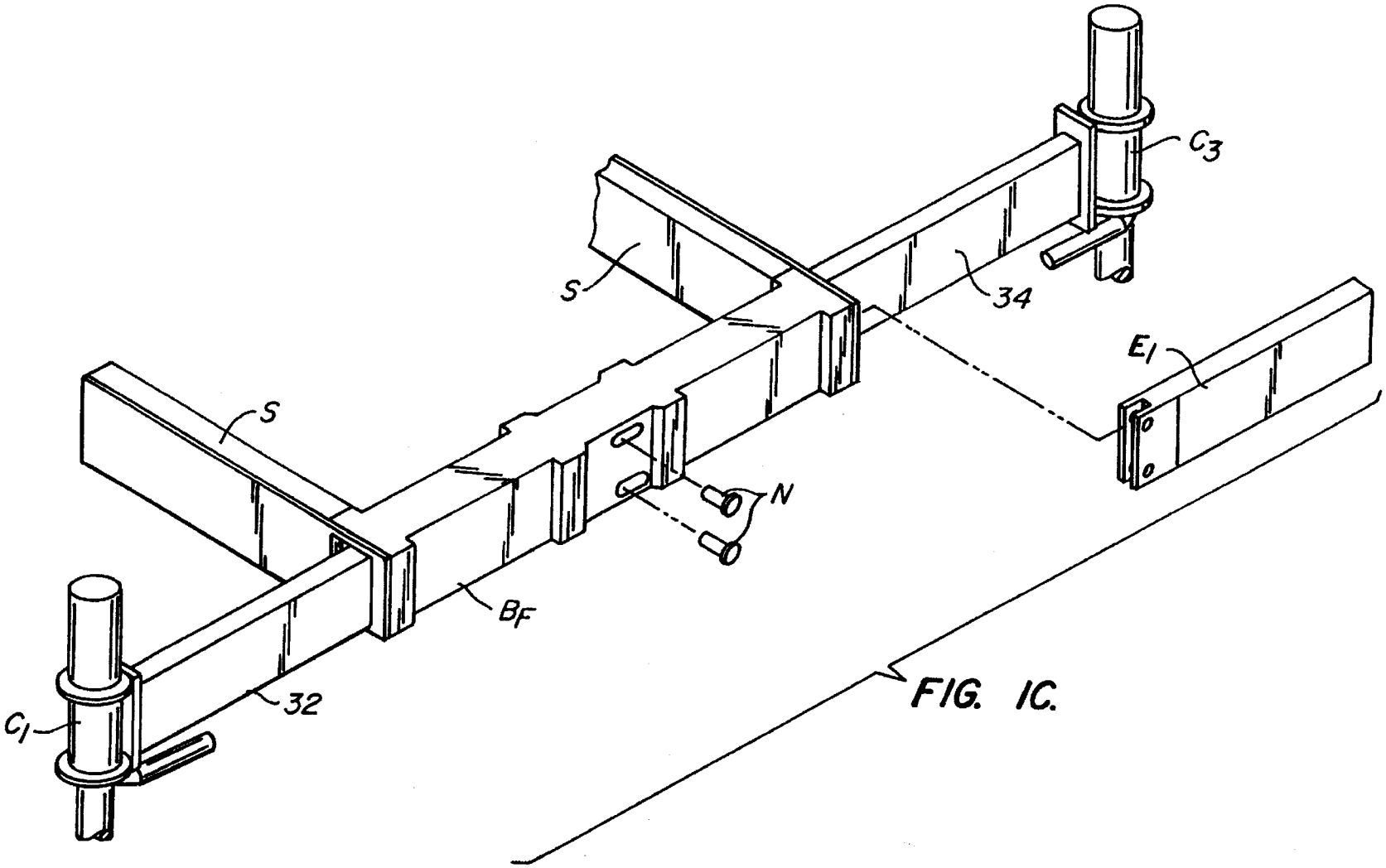
FIG. 1C is a detail of the insertion of the extending members—it being understood that light lifting equipment (not shown) causes the required insert of the extender.

FIG. 1A illustrates paver P proceeding in paving direction 15 for paving roadway or runway R. Paver P includes tractor frame F and paving kit K. Since the invention herein relates to the configuration of tractor frame F, paving kit K will be briefly discussed. In the description here, it will be assumed that conventional paving kit may be removed or attached from tractor frame F for the purposes of transport or to add other attachments without further discussion.

Paving kit K is conventional and includes spreader plow 18. Spreader plow 18 functions to spread concrete placed in paving direction 15 on what is to become roadway or runway R. There follows metering gate, vibrators, slipform pan 22 and trailing pan 24. It will be understood that paving kit K can be augmented with all sorts of accessories. Reinforcing bar inserters, tamper bars, side bar inserters and the like are typically added or taken off the machine as the job requires.

It will be understood that the width of the paving kit K is varied with extensions like the tractor frame F as the particular width of the job specifies. Such paving kit extensions come in all matter of widths. It is common to have one foot, two foot, three foot, five foot, and six foot extensions. In the conventional placement of these sections, the telescopic tractor frame is first expanded, and the requisite number and length of paving kit extensions installed. Since this process is conventional, it will not be further discussed herein.

The operation of a paver can be simply stated for purposes of this description. Typically, a system of grade level reference wires W are strung adjacent and parallel to the roadway or runway grade being constructed. Sensors 26 with wire feelers, one located at each corner of the machine attached to the frame, follow grade level reference wires W. Leveling sensors (not shown) on the frame independently adjusts the height of the frame relative to each of crawlers $T_1$–$T_4$ through hydraulic cylinder $C_1$–$C_4$ at each corner of the frame. The paving kit suspended from the frame thus is continually adjusted to maintain a preset elevation disposition relative to the wires as paving occurs.

Frame F can be best understood with a first reference to FIG. 1A. Frame F includes side relatively telescoping members S. These respective side relatively telescoping members S are fully set forth and described in Guntert et al U.S. patent application Ser. No. 08/450,242, filed May. 25, 1995 entitled FOUR TRACK PAVING MACHINE WITH TELESCOPING TRANSPORT COMPRESSION IN DIRECTION 0F PAVING MACHINE TRAVEL. An abbreviated description of the function of these side relatively telescoping members S will suffice.

Four track paver P is disclosed having a frame with side relatively telescoping members S or side bolsters which contract for transport to reduce the dimension of the machine in the direction of paving machine travel 15. The rectilinear frame includes four crawlers $T_1$–$T_4$, one at each corner of the frame. Each crawlers $T_1$–$T_4$ is directly supported on its own hydraulic cylinder $C_1$–$C_4$ and mounted for pivotal movement about the axis of the hydraulic cylinder. The frame telescopes at side relatively telescoping side bolster members S between the leading and trailing crawlers at the sides of the machine. When expanded, the paving machine has the full forward and rear dimension required for paving. When contracted, the paving machine has a profile allowing convenient transport with the crawlers rotated 90° or normal to the direction of travel to power the frame widening. Full details of this function of the machine can be realized by consulting the above reference patent application which is incorporated by reference into this patent application. Conventional four track paver side bolsters with pivoting arms can also be used with the present application. It is envisioned that the present application can also be used with two track paver provided external hydraulic cylinders are utilized to provide the power to telescope in the absence of four crawler tracks and the ability of turning the four crawlers 90° or normal to the direction of paving to power the frame widening.

The present application relates to the side to side paving expansion of paver P. This being the case, attention will now be directed to FIG. 3. This figure is advantageous because it focuses on the paving width extension of the paver telescopic tractor frame and does not show the appurtenant apparatus.

Rectilinear tractor frame F includes forward box Beam $B_F$ and rear box beam $B_R$. Each forward box beam $B_F$ and each rear box beam $B_R$ defines leading interior female compartment 28 and trailing interior female compartment 30. Thus, side relatively telescoping members S and forward box beam $B_F$ and rear box beam $B_R$ define a rectilinear tractor frame F.

It is conventional with some pavers P to include telescoping expansion across the paving width. Accordingly, forward box beam $B_F$ and rear box beam $B_R$ each define forward female telescoping member $F_F$ at leading interior female compartment 28 and rear female telescoping member $F_R$ at trailing interior female compartment 30.

It is required that male telescoping members be received into the respective female telescoping members. This being the case, right forward male telescoping member 32 is received in forward female telescoping member $F_F$ of forward box beam $B_F$. Similarly, left forward male telescoping member 34 is received in rear female telescoping member $F_R$ of forward box beam $B_F$.

The trailing section of the frame is identically constructed. Right trailing male telescoping member 36 is supported in forward female telescoping member $F_F$ of rear box beam $B_R$. Similarly, left trailing male telescoping member 38 is supported in rear female telescoping member $F_R$ of rear box beam $B_R$.

Dimensions are important. Therefore, reference will be made to the dimensions important here utilized in the United States. It is envisioned that this invention will be adaptable to dimensions important to other parts of the world that incorporate Metric Dimensions.

Forward box beam $B_F$ and rear box beam $B_R$ are typically a nominal 12 feet in length. Respective right forward male telescoping member 32, left forward male telescoping member 34, right trailing male telescoping member 36, and left trailing male telescoping member 38 are also 12 feet in length. This enables the leading and trailing male telescoping members to be entirely received within forward box beam $B_F$ and rear box beam $B_R$. It can therefore be quickly understood by the reader that the present machine has a capability of paving over a 12 foot span to match the minimum paving width generally paved in the United States. Even though the tractor frame might be limited to a minimum width of 12', when the telescopic frame is fully contracted, the paving kit may be arranged in a paving width less than 12'.

Expansion of paver P at any width between 12 and 25 feet can be readily understood. It is known that during telescoping movement or expansion of paver P, connection and disconnection of hydraulic jacking columns (hereinafter called cylinders) $C_1$–$C_4$ is not desired. Accordingly, the respective cylinders $C_1$–$C_4$ are all attached at the distal ends of respective right forward male telescoping member 32, left forward male telescoping member 34, right trailing male telescoping member 36, and left trailing male telescoping member 38. Crawlers $T_1$–$T_4$ conventionally attach to hydraulic cylinders $C_1$–$C_4$. For the purposes of this illustration, FIG. 3 does not show the side bolsters and only shows the cylinders $C_1$–$C_4$ and crawler tracks $T_1$–$T_4$ attached to their respective corner. Presuming that crawlers $T_1$–$T_4$ are rotated 90° by respective turning cylinders 40, it can be seen that powering of crawlers $T_1$–$T_4$ can move to extend the respective male telescoping members 32, 34, 36, and 38. In a normal extension process, the respective male telescoping members 32, 34, 36, and 38 would all be extended in the range of six to six and one half feet. This would extend the paver tractor frame from 12 foot to a maximum range of a 25 foot span. In the prior art, this is the maximum paving width extension that such a paver would allow.

The reason for this maximum extension can be easily understood. It will be understood that male telescoping members 32, 34, 36, and 38 are in cantilever support when extended from the respective forward box beam $B_F$ and rear box beam $B_R$. Further, the paver is heavy, weighing in the order of 75,000 pounds or more. It is therefore to be understood that extension of male telescoping members 32, 34, 36, and 38 substantially beyond a six foot extension is not prudent. Thus a certain minimum length of male telescoping member must remain engaged in the female box beam frame section to maintain the structural integrity of the tractor frame. Moreover, in the prior art and in most cases, power for the extension of the telescopic tractor frame was provided by hydraulic cylinders or screw jacks located either inside or outside the telescopic members and which were connected between the male and female telescopic tube. These hydraulic cylinders or screw jacks had the ability to extend the male telescoping members away from the female telescopic tube to its entire extended length or a portion of it, where in such cases, an extension to the extending cylinder or screw jack was required.

In the prior art, the only way the paver telescopic tractor frame could be extended beyond the maximum telescopic ability of 25' was to unbolt and hydraulically disconnect the cylinders $C_1$–$C_4$ and crawler tracks $T_1$–$T_4$ from each corner of the machine and add a fixed frame extension to the ends of the male telescopic members 32, 34, 36, and 38 and the cylinders $C_1$–$C_4$.

Figure 5:
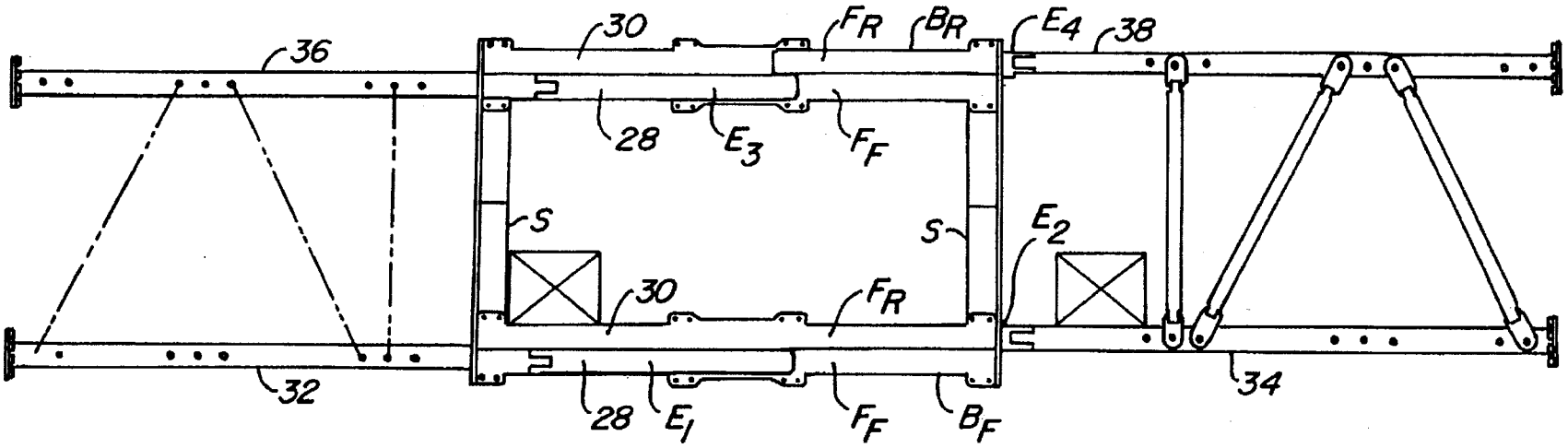
FIG. 5 is a plan schematic of the frame illustrating offset of the paver frame in expansion for positioning a reinforcing bar inserter at a position where interference with the frame member does not occur.

Having set forth this limitation, extenders $E_1$–$E_4$ can now be discussed. This may be most conveniently done by considering the disposition of tractor frame F as illustrated in FIG. 3 and thereafter discussing the extension of the frame as illustrated in FIG. 5.

Figure 3:
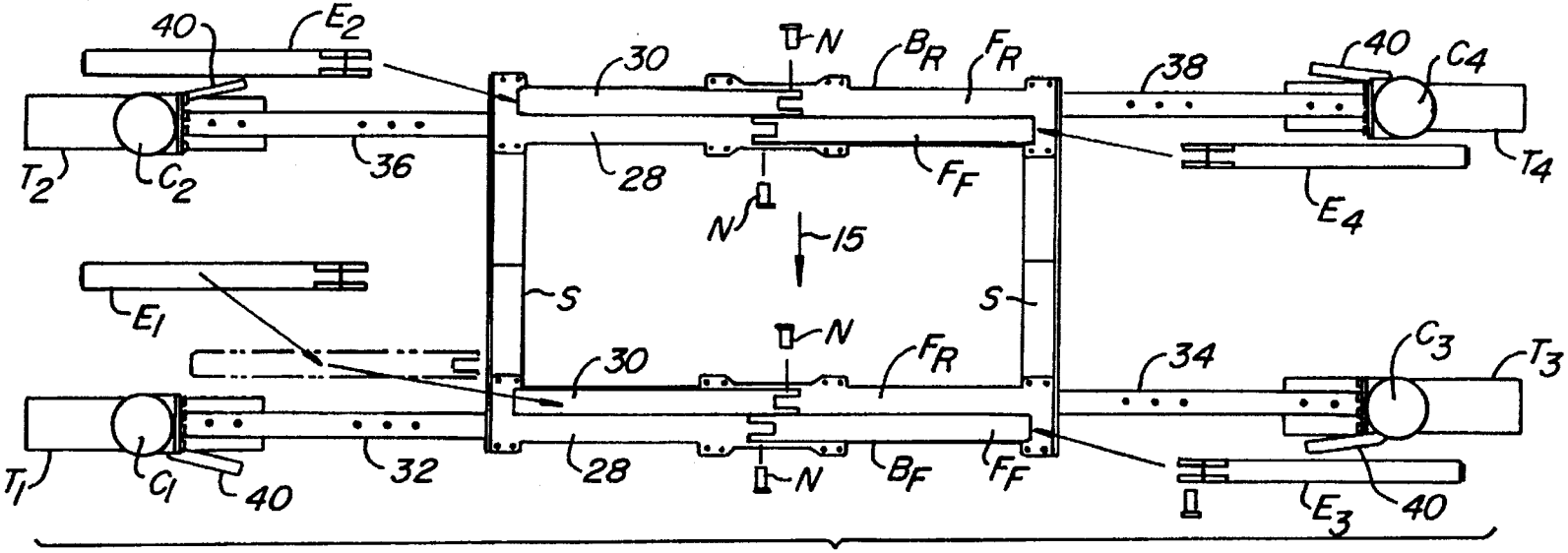
FIG. 3 is a plan schematic of the frame illustrating the principle of extension insertion for expanding the frame, the paver side bolsters not being shown.

Before insertion of extenders $E_1$–$E_4$, it is required that tractor frame F be expanded to the approximately 25 foot span illustrated in FIG. 3. This defines clearance required for receipt of extenders $E_1$–$E_4$ in two discrete aspects.

First, the respective forward female telescoping member $F_F$ and rear female telescoping member $F_R$ of forward box beam $B_F$ and rear box beam $B_R$ are open on the ends for receipt of extenders $E_1$–$E_4$. Second, hydraulic cylinders $C_1$–$C_4$ and crawlers $T_1$–$T_4$, are sufficiently moved away from forward box beam $B_F$ and rear box beam $B_R$ so as to define clearance for insertion of extenders $E_1$–$E_4$.

It should be noted that insertion of extenders $E_1$–$E_4$ is a relatively simple matter that can be handled by the on-site operating crew of the paver. Specifically, by utilizing a fork lift, boom truck or similar lifting apparatus, each of extenders $E_1$–$E_4$ can be individually inserted. At the same time, detachment of heavy hydraulic cylinders $C_1$–$C_4$ and crawlers $T_1$–$T_4$ is not required.

Figure 4B:
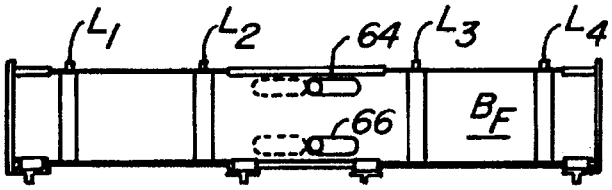
FIG. 4B is an elevation of the forward box beam of the paver frame illustrating apertures for insertion of pins to effect fastening of the extenders with the hidden lines showing apertures located on the inner female telescoping tube.
Figure 4A:
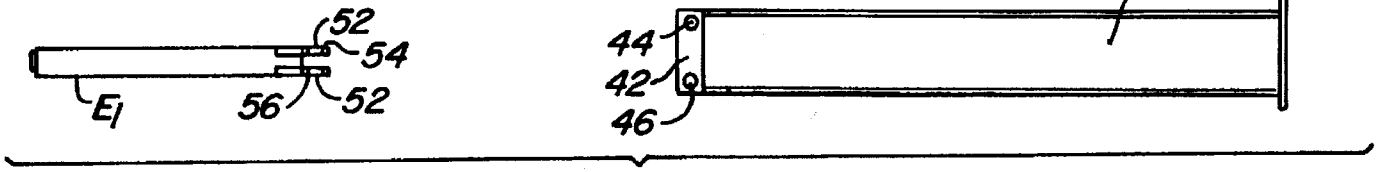
FIG. 4A is a side elevation of the female telescoping member and a plan and elevation of the extender member illustrating apertures for the installation of pins to enable connection interior of the female telescoping tube of the extenders to the male member.

Referring to FIG. 4A, right forward male telescoping member 32 is illustrated without attachment of either hydraulic cylinder or crawler. It defines single male connector plate 42 at its end opposite from where the hydraulic cylinder and crawler is attached. Single male connector plate 42 is bored by upper pin aperture 44 and lower pin aperture 46.

The construction of extender $E_1$ is analogous. It includes paired female connector plate members 52 which are in turn bored by upper pin aperture 54 and lower pin aperture 56.

Figure 7:
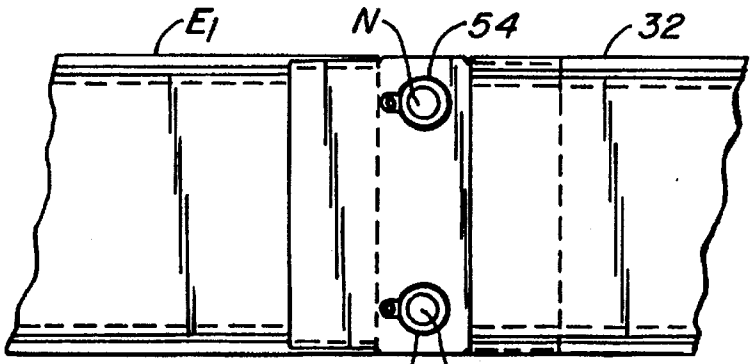
FIG. 7 is a detail of the male telescoping member connected to an extender, and applicable pins inserted through the female telescoping member, it being noted that line up pin holes may be required in the male telescopic member and extender connection for ease of pin hole line up.
Figure 6:
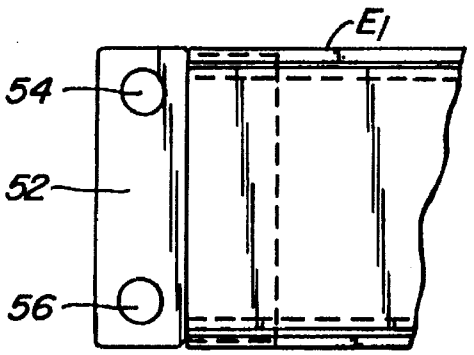
FIG. 6 is a detail illustrating the connecting end of the extender to the male telescoping member.

Fastening of the member together is conventional. Referring to the details of FIGS. 6 and 7, such attached can be readily understood. Specifically, by placing pins N across the respective apertures 44, 54 and 46, 56, extenders $E_1$–$E_4$ can be rigidly attached to their respective male telescoping members 32, 34, 36, and 38.

There remains to be understood how such pinning can occur within forward box beam $B_F$ and rear box beam $B_R$. The detail of forward box beam $B_F$ in FIG. 4B provides elongate upper aperture 64 and elongate lower aperture 66 in forward box beam $B_F$. By registering the respective ends of extenders $E_1$–$E_4$ to the respective male telescoping members 32, 34, 36, and 38, ready access for the required insertion of pins N can occur.

It is necessary that the respective forward box beam $B_F$ and rear box beam $B_R$ have clamps for firm attachment to the respective male telescoping members 32, 34, 36, and 38. To this end, clamps $L_1$–$L_4$ are illustrated only at forward box beam $B_F$ in FIG. 4B. To avoid confusing detail, these respective clamps are not set forth elsewhere in the drawings.

Further, a word about the practical aspects of inserting pins N. In a heavily loaded paver P, it will be understood that some gross manipulation of the paver will be required for precise pin placement. This being the case, clamps $L_1$–$L_4$ can be manipulated, paver P and kit K can be raised and lowered and a portion of the tractor weight taken by four stanchions located at the four corners of the female telescopic tractor member, and both the male telescoping member and the particular crawler moved to effect pin placement.

It will further be understood, that expansion and contraction of paver P can occur through crawlers $T_1$–$T_4$. The paver P is designed so the crawler tracks on each side of the machine can be controlled together as a pair. This provides the power for driving the telescoping movement. In the case where this tractor frame is used in conjunction with two track machines, where four crawlers are not available for driving the telescoping movement, conventional external hydraulic cylinders as used in the prior art, connected between the male and female telescopic members, can be used to power the telescopic movement.

There remains to be considered the expanded disposition of tractor frame F as illustrated in FIG. 5. As shown in FIG. 5, paver P is expanded to a maximum design paving width of 34 feet. Normally, such expansion will be symmetrical; each of the male telescoping members 32, 34, 36, and 38 will extend the same distance. Since this is easily comprehended, we illustrate the case where eccentric expansion has occurred. A word of explanation of the need for eccentric expansion can be helpful.

As has been previously emphasized, paver P frequently includes installed accessories such as bar inserters, side bar inserters, and other accessories as the vagaries of any job may require. At the same time, the transverse spacing of such accessories may interfere with placement of the major structural members of tractor frame F such as side relatively telescoping members S. This being the case, eccentric expansion such as that illustrated in FIG. 5 can act to register attached accessories to their required location.

Referring to FIG. 5, it can be seen that extenders $E_2$ and $E_4$ protrude partially from forward box beam $B_F$ and rear box beam $B_R$, respectively. On the other side, extenders $E_1$ and $E_3$ do not protrude at all from rear box beam $B_F$ and rear box beam $B_R$, respectively. This gives the disclosed apparatus a flexibility of dimension that is highly practicable.

Figure 2:
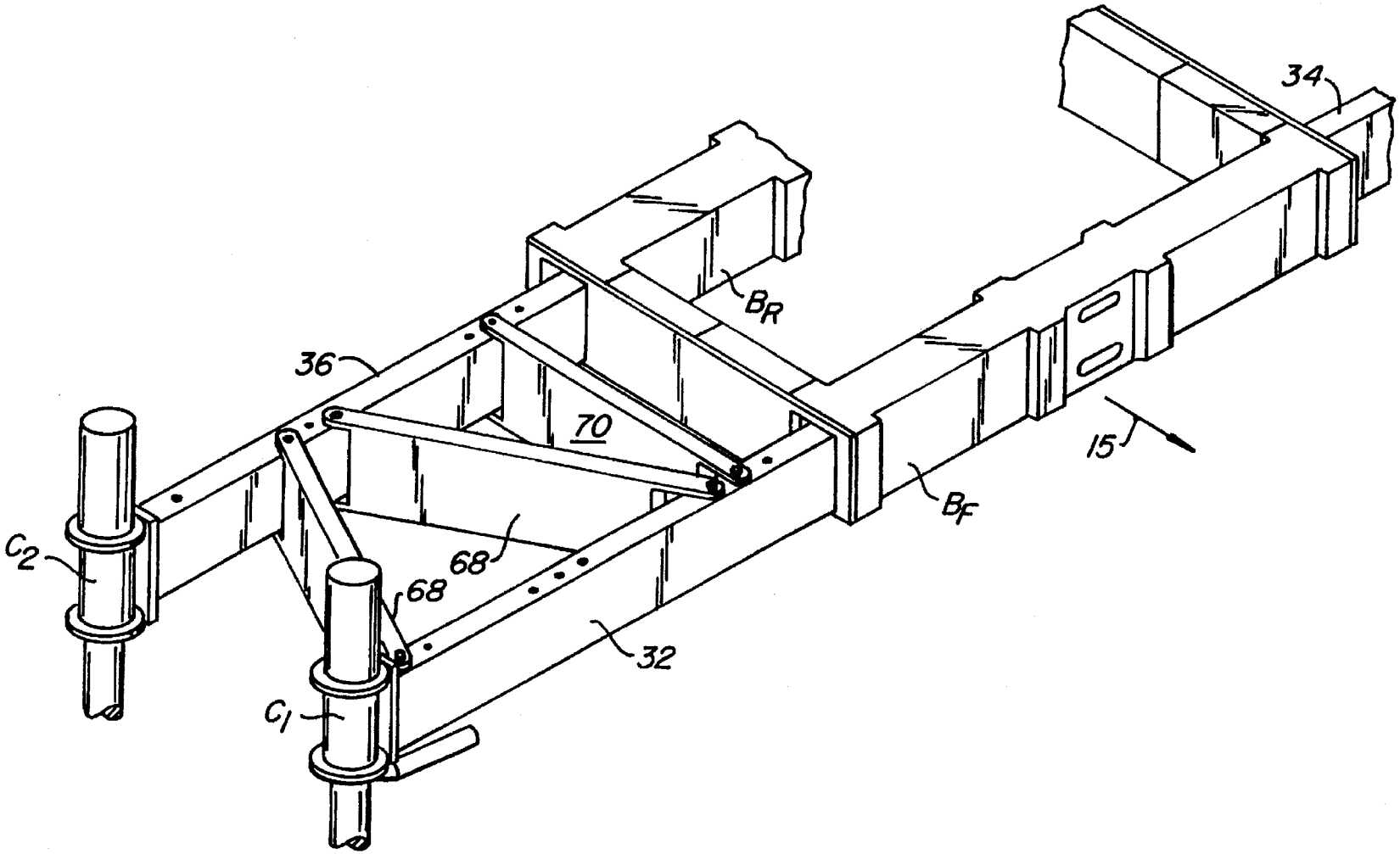
FIG. 2 is a perspective view that illustrates one side of the paver extended to the increased width for paving a wider slab, the other side of the paver not being shown and shows the light bracing members in position.

It is apparent, that when male telescoping members 32, 34, 36, and 38 are fully extended, cross bracing of paver P will be desired—if not required. Referring to FIG. 2, such cross bracing is illustrated. Specifically, with extenders $E_1$–$E_4$ installed and male telescoping members 32, 34, 36, and 38 extended, two types of cross bracing can be utilized. Diagonal cross brace 68 and normal cross brace 70 can be used with conventional fastening as by bolts or pins occurring at the distal ends of the braces 68, 70 to male telescoping members 32, 34, 36, and 38. It is envisioned that one or both of the distal ends of the cross bracing may include a screw adjustable attachment bracket so that the length of the brace does not have to be exact.

Figure 8:
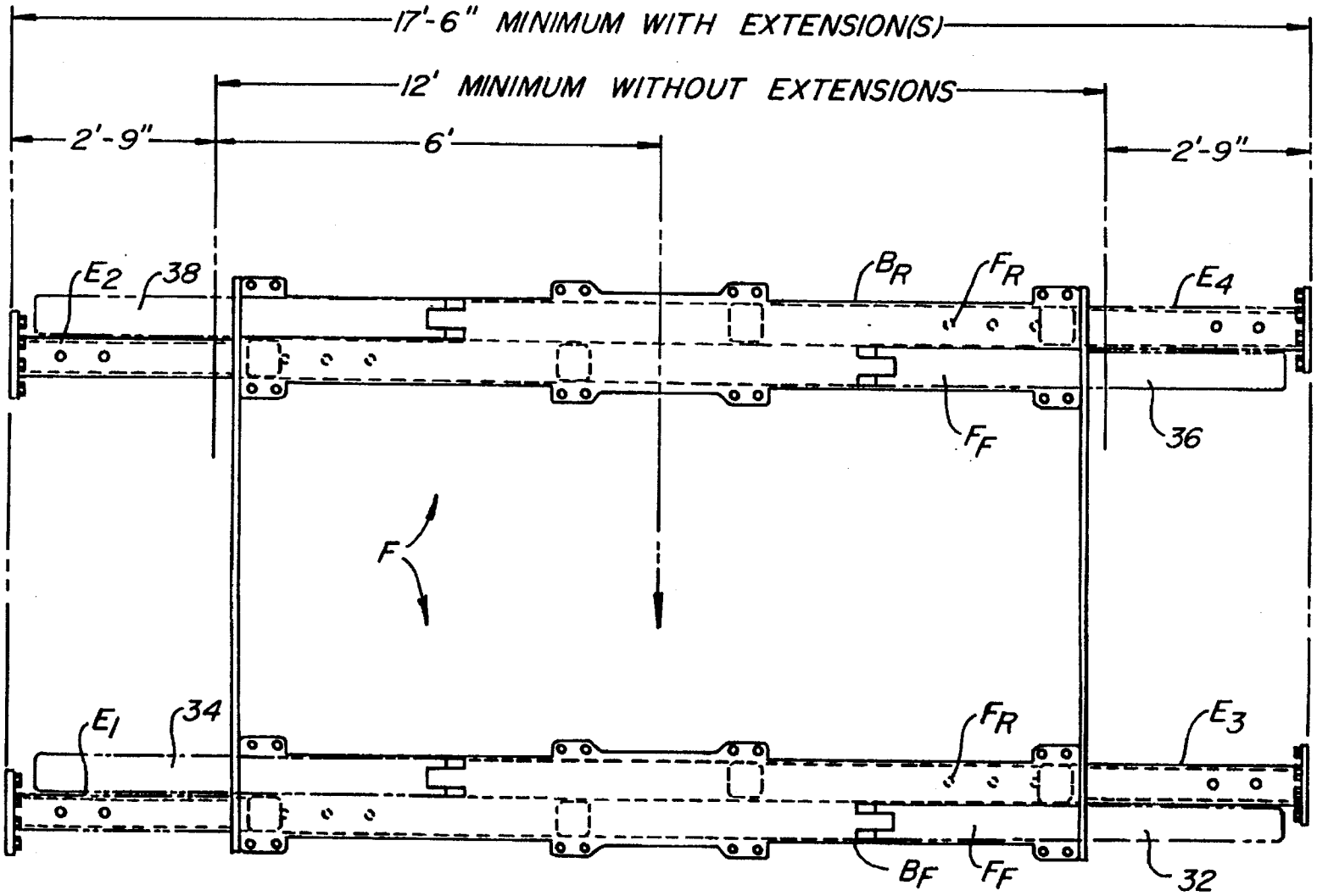
FIG. 8 is a partial plan view of the frame illustrating the case where the extenders are attached and the frame is contacted to minimum dimension.

There also needs to be considered the minimum contracted disposition of the tractor frame F as illustrated in FIG. 8 with the extenders attached. As shown in FIG. 8, paver P (not completely shown) is contracted to its minimum design paving width of 17'6" with the extenders $E_1$–$E_4$ still attached. Because the female telescoping members $B_R$, $B_F$, $F_F$, $F_R$ are all open on the end to receive extenders, the male telescoping members 32, 34, 36 and 38 can be contracted until they interfere with the side bolsters. In prior art, as stated above, the maximum range of telescopic ability of the tractor frame was six to six and one-half feet per side, or a telescopic range of 12'to 25'. Because of the opening on the ends of the female telescoping members, the male telescopic members may be contracted beyond the ends of the female tubes by approximately three feet on a side. Thus the resulting range of telescopic ability is 17'6" to 34', or eight and one quarter feet side.

The reader will understand that detail of attachment of paving kit K has been in the large part omitted. This omission is intentional as this attachment is standard and well understood by the prior art. It is further understood that this paving kit can be substituted with a concrete spreading/placing kit or a base spreading/finegrading kit.

It will be further understood that this invention is equally applicable to both two track and four track pavers. This being the case, it is understood that the tractor of this invention includes at least two crawler tracks with one crawler on either side of the paver. A tractor having four crawler tracks is included in this definition.

In the above specification, we have illustrated the preferred embodiment to include male and female telescoping members. The reader is to understand that these respective terms are used in the broadest possible sense. What is required is that the two members move relative to one another with cantilever support being taken by one member from an adjacent member. Thus, all types relatively sliding support and extension schemes are intended to be covered. These include conventional telescoping connection, and side-by-side members which slide relative to one another and provide in the extended position relative support to one another.

In development of this invention, it has been discovered that location of the pins between the male telescoping member and the extender needs to be facilitated. Accordingly, the now preferred interconnection between the extender and male telescoping member is illustrated in FIGS. 9A, 9B, 10, 11A and 11B.

Figure 9A:
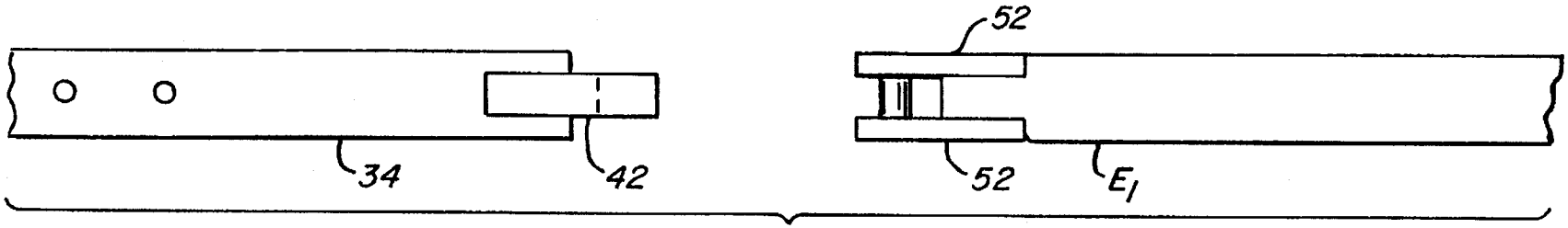
FIG. 9A and 9B are respective plan view and side elevations of the male telescoping member and extender separated from one another so that the gathering feature of this invention can be understood.
Figure 9B:
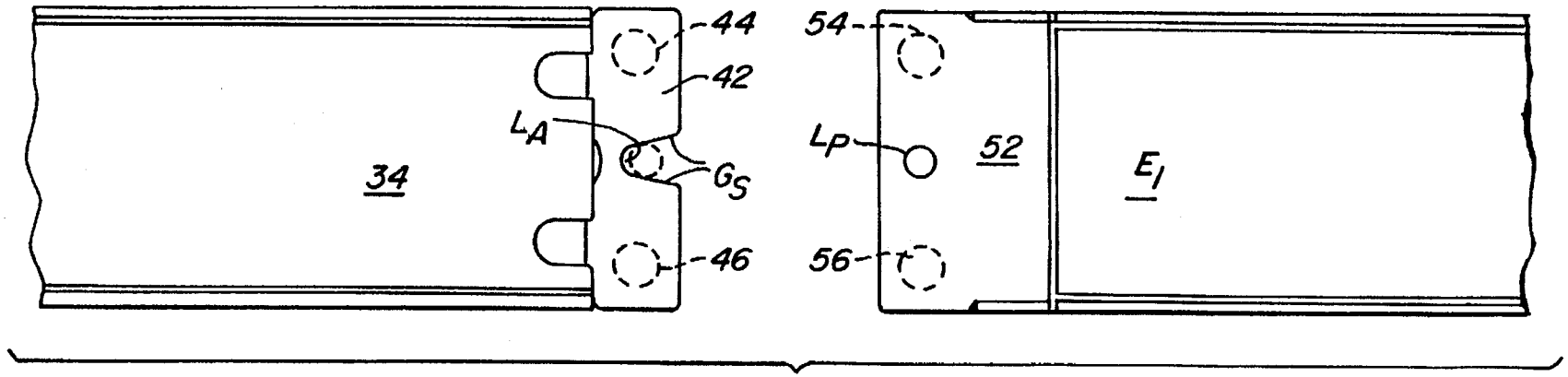
Figure 10:
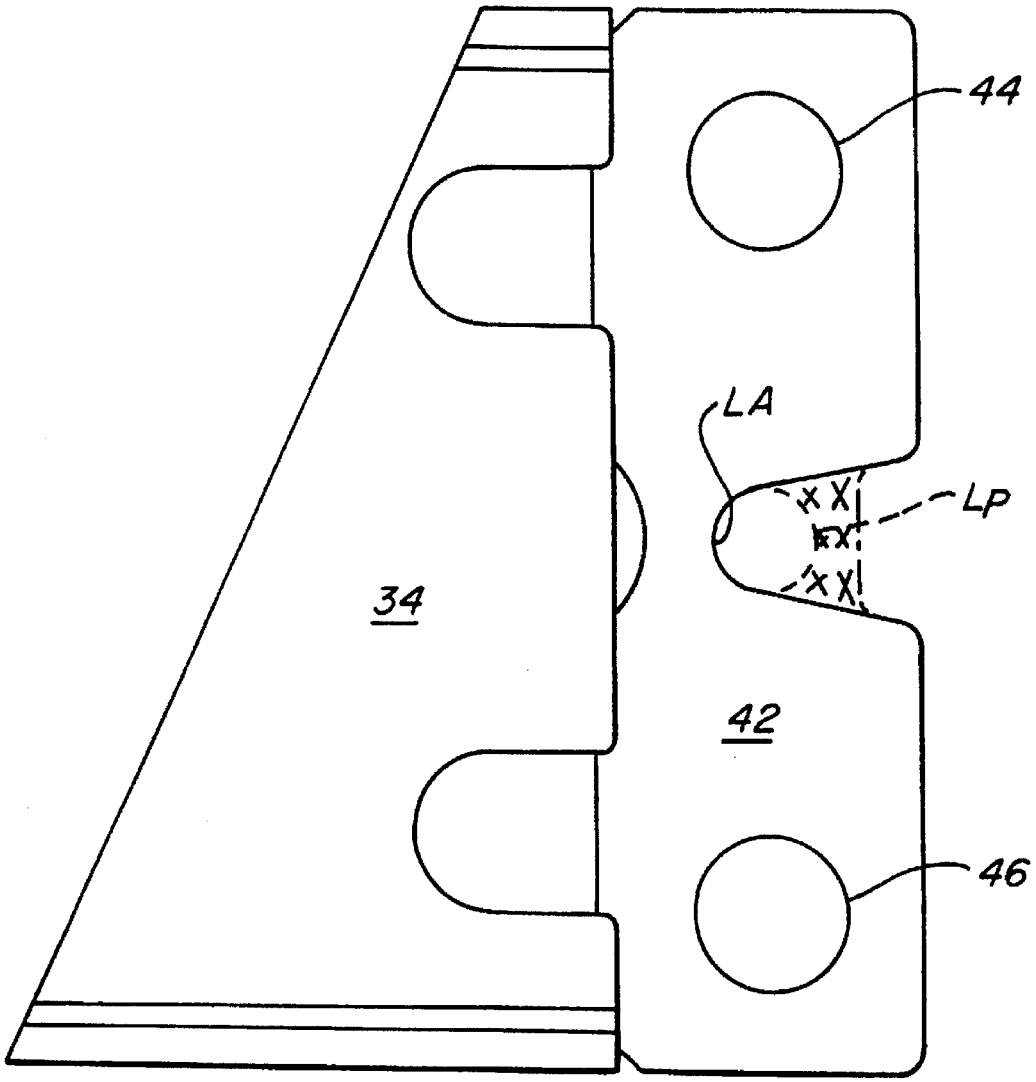
FIG. 10 is a side elevation of the single male member attached to the male telescoping member; and, FIGS. 11A and 11B are respective side elevation section at the box beam illustrating the juxtaposition of the male telescoping member and extender interior of the box beam and a detail of the recess and securing leaf for the inserted fastener pins.

Referring to FIGS. 9A and 9B, left forward male telescoping member 34 and extender $E_1$ is illustrated. Specifically, paired female flange members 52 are provided with locator pin $L_p$. Locator pin $L_p$ is centered on the neutral axis of extenders $E_1$.

Similarly, left forward male telescoping member 34 at single male flange 42 has locator aperture $L_A$. Locator aperture $L_A$, like locator pin $L_p$ is centered on the neutral axis of left forward male telescoping member 34. Locator aperture $L_A$ includes gathering surfaces $G_S$ flaring out from locator aperture $L_A$. These respective gathering surfaces $G_S$ cause left forward male telescoping member 34 and extenders $E_1$to come into registration as illustrated in FIG. 11A.

In actual operation, the respective male telescoping members such as left forward male telescoping member 34 are moved outward until upper pin aperture 44 and lower pin aperture 46 register within respective elongate upper aperture 64 and elongate lower aperture 66. Thereafter, the extenders, such as extenders $E_1$ is typically picked by lifting apparatus central of the extender and inserted to forward box beam $B_F$, Insertion continues until locator aperture $L_A$ centers on locator pin $L_p$. Once centering occurs, the distal end of extenders $E_1$ is moved up and down until centering of pins N in either the upper or lower position can occur.

Stopping here, and assuming that one of pins N is in place with locator aperture $L_A$ registered to locator pin $L_p$, the remain apertures will by definition be centered. Insertion of the remaining pin is all that is required to occur.

Figure 11A:
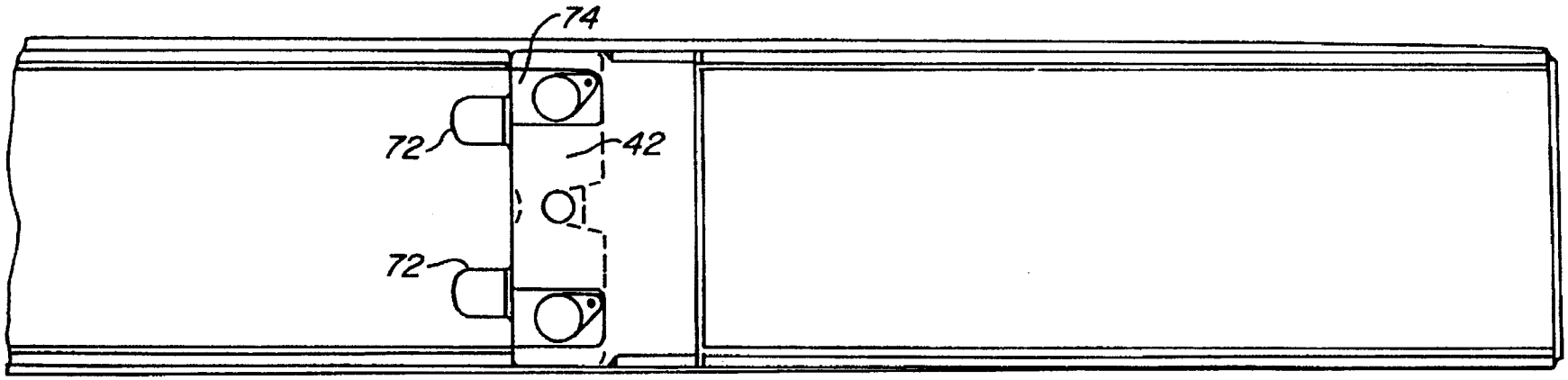
Figure 11B:
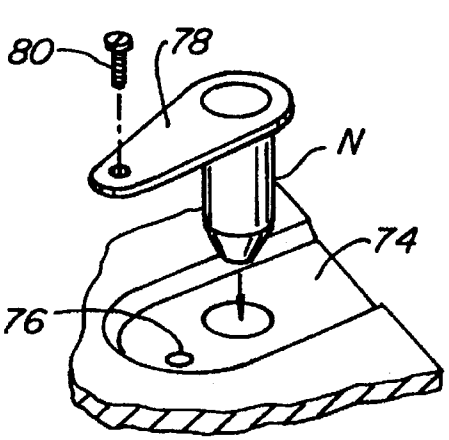

Referring to FIGS. 11A and 11B, some details can be considered. First, in the installation of single male flange 42 to left forward male telescoping member 34, firm welded connection is required. For this reason, U-shaped weld indentations 72 are made between left forward male telescoping member 34 and single male flange 42.

Second, it is necessary that pins N be secured in such a manner that they do not interfere with the box beams such as forward box beam $B_F$. Specifically, single male flange 42 is provided with recessed pin platform 74. Referring to FIG. 11B, it can be seen that pin N has attached fastening leaf 78 through which bolt 80 threads to fastening tap hole 76. Connection of pins N results with recessing of the pin so that interference with the respective box beams, such as forward box beam $B_F$, does not occur.

What is claimed is:

1. A paving machine having a tractor frame for propelling the paving machine along a paving path, said paving machine further including:

a box beam attached to the tractor frame, a male member telescoping with respect to the box beam, a crawler affixed to a distal end of the male telescoping member for support of the frame through the male telescoping member, an extender member to enable enhanced support of the male telescoping member from the box beam, paired leaf members affixed to one of said extender member and male telescoping member;

a single leaf member affixed to the other of said extender member and male telescoping member;

said paired leaf members and said single leaf member each being cross bored for receiving pins for locking said paired leaf members and said single leaf member in fixed relation one to another;

a locator pin disposed between the paired leaf members;

a locator aperture with gathering surfaces disposed on the single leaf member, the locator pin and locator aperture with gathering surfaces disposed for mutual alignment upon confrontation relative to the cross bores of the leaf members to effect registration of the cross bores upon alignment of the locator aperture and locator pin.

* * * * *